United States Patent [19]

Bleibtreu

[11] Patent Number: 4,931,599

[45] Date of Patent: Jun. 5, 1990

[54] STEP SELECTOR FOR A STEPPED TRANSFORMER

[75] Inventor: Alexander Bleibtreu, Regensburg, Fed. Rep. of Germany

[73] Assignee: Maschinenfabrik Reinhausen GmbH, Regensburg, Fed. Rep. of Germany

[21] Appl. No.: 389,423

[22] Filed: Aug. 3, 1989

[30] Foreign Application Priority Data

Aug. 12, 1988 [DE] Fed. Rep. of Germany ..... 3827385

[51] Int. Cl.[5] ..... H01H 19/58; H01H 1/50

[52] U.S. Cl. ..... 200/11 B; 200/11 TC; 200/260

[58] Field of Search ..... 200/11 B, 11 C, 11 TC, 200/8 R, 14, 15, 254, 282, 257, 260, 252

[56] References Cited

U.S. PATENT DOCUMENTS

| | | | |
|---|---|---|---|
| 2,751,447 | 6/1956 | Bartlett et al. | 200/11 B X |
| 3,045,090 | 7/1962 | Wilson, Jr. et al. | 200/11 B X |
| 3,137,778 | 6/1964 | Barr | 200/254 X |
| 3,396,428 | 8/1968 | Wilson, Jr. | 200/11 Bb X |

FOREIGN PATENT DOCUMENTS

| | | | |
|---|---|---|---|
| 199759 | 9/1958 | Austria . | |
| 1276191 | 8/1968 | Fed. Rep. of Germany | 200/11 TC |

*Primary Examiner*—J. R. Scott

*Attorney, Agent, or Firm*—Herbert Dubno; Ronald Lianides

[57] ABSTRACT

A step selector for a stepped transformer has an electrically insulating cylindrical wall provided with fixed contacts, e.g. at different levels and, for each contact level, a radial arm composed wholly of electrically insulating material is affixed to a cylindrical shaft rotatable about the axis of the cylinder and within the latter. The radial arm has a flange lying against the shaft and extending over substantially 120° of an arc thereof. An inward projection on the flange engages a recess in the shaft and the flange is held against the shaft by at least one band of fibrous material impregnated with a self-hardening synthetic resin. The outer end of the arm carries a contact bridge slidable on a contact ring which nonrotatably surrounds the shaft and lies in the plane of the respective fixed contact which is engageable by the bridge.

7 Claims, 1 Drawing Sheet

STEP SELECTOR FOR A STEPPED TRANSFORMER

CROSS-REFERENCE TO RELATED APPLICATION

This application is related to the concurrently filed U.S. application Ser. No. 07/389,429 and U.S. application Ser. No. 07/389,422, respectively based upon German Patent Applications No. P 38 27 386.1 of Aug. 12, 1988 and P 38 29 489.3 of Aug. 31, 1988.

FIELD OF THE INVENTION

My present invention relates to a cylindrical step selector for a stepped transformer and, more particularly, to a step selector of the type in which a rotatable shaft carries generally radial arms, each of which entrains a bridging piece in sliding contact with a stationary contact ring into engagement with a fixed contact in a wall of a cylinder.

BACKGROUND OF THE INVENTION

In the Austrian Patent Document No. 199,759, a step selector for a stepped transformer is described which comprises a plurality of fixed contacts respectively associated with the steps of a transformer in at least one plane in a wall of an electrically insulating cylinder. For each of these planes, a respective contact bridge is provided. The inner end of each contact bridge slidably engages a contact ring which is also connected in the electric circuit. The contact bridge is entrained by an arm extending generally radially from and connected to a switching shaft which is rotatable about the axis of the cylinder. The outer end of each contact bridge is engageable with the or each fixed contact lying in the aforementioned plane.

In the past, it has been necessary to attach the support arm for the contact bridge with metallic parts so that there was always the possibility of voltage jumping, excessive arc extension and the like which could be detrimental to the breakdown voltage of the selector and could lead to premature deterioration thereof.

OBJECTS OF THE INVENTION

It is, therefore, the principal object of the present invention to provide an improved step selector for the purposes described which will be free from the last mentioned drawback.

A more specific object of this invention is to provide a step selector of the type described which is free from metallic parts in the connection of the support arm with the selector shaft.

Still another object of the invention is to provide a step selector with a minimum number of metallic parts and which, especially, is free from metallic parts in the connection of the support shaft for the bridge contact with the selector shaft.

SUMMARY OF THE INVENTION

These objects and others which will become more apparent hereinafter are attained, in accordance with the present invention, by providing a support arm having a flange at its inner end which conforms to and extends over about 120° of the cylindrical outer surface of the support shaft, the support arm being composed of an electrically insulating material. The step selector shaft, which is also composed of an insulating material, can be formed with a recess into which a projection on said flange can extend, this projection being unitary with the flange.

According to an important feature of the invention, the flange is held against the support arm by at least one band of thermosetting or other hardening resin impregnated fibrous material which can be wound in at least one turn around the shaft and the flange so as to attach the two together.

Thus the cylindrical step selector of the invention distinguishes over the arrangement shown in the Austrian patent in that the support arm is formed entirely cut of the insulating material and is molded unitarily with the radial portion of the arm and with the flange which lies against the electrically insulating preferably tubular, cylindrical shaft. The recess can be a throughgoing opening formed in the wall of the support shaft and the resin can be a self-hardening resin, preferably an epoxy resin or some other thermosetting resin capable of bonding to the synthetic resin material of the shaft and of the flange.

A cylindrical step selector for a stepped transformer thus can comprise:

a cylinder having an electrically insulating wall;

a fixed contact for switching a respective transformer step mounted in the wall in a respective plane perpendicular to an axis of the cylindrical wall, whereby each step can have a respective such contact lying in a respective such plane;

a generally cylindrical rotatable switching shaft of electrically insulating material disposed along the axis inwardly of the cylinder wall;

an electrically conductive contact ring lying generally in the plane and surrounding the shaft without rotatable entrainment by the shaft;

a bridge support affixed to the shaft, the support being formed with:

a generally radial arm, a flange at one end of the arm shaped to conform to the shaft and fitting around the shaft over substantially 120° thereof, a projection formed on the flange and engaged in a recess formed in the shaft, and at least one self-hardening insulating band of a resin impregnated material wrapped around the shaft and the flange and securing the support to the bridge shaft;

an electrically conductive contact bridge carried by the other end of the arm and slidably engaging the contact ring and engageable with the fixed contact; and means forming an electrical connection with the contact ring.

In this system, preferably, the shaft is tubular. The contact bridge can comprise a pair of contact members straddling a portion of the arm and extending radially in opposite directions beyond this portion of the arm into slidable engagement with the contact ring and the fixed contact.

Means can be provided for resiliently pressing these members toward one another, this means advantageously including pins projecting through the aforementioned portion of the arm and the members and surrounded by openings braced against heads of the pins and the members.

Advantageously, two of the self-hardening insulating bands of resin-impregnated material are provided on axially opposite sides of the arm.

The contact ring can surround the shaft with all-around clearance and can be supported within the cylindrical wall by the means forming the electrical connection with the contact ring. The latter means may be provided with bracing strips of the type described in the copending U.S. application Ser. No. 07/389,429.

The step selector of the invention has the important advantage in that all of the metallic parts are avoided except where these parts must participate in the current flow path. In spite of the absence of metallic parts, there is a reliable attachment of the support arm for the contact bridge on the switching shaft because of the manner in which the flange is attached to the shaft.

The invention makes it possible for three such support arms, each having a flange extending over 120°, to be mounted in the same plane perpendicular to the axis of the switching shaft as is the case where, for example, where a three-phase step selector is required with identical support arms and contact bridges for certain transformers. Generally, however, the support arm will be located at axially spaced rings of the shaft, noting the commonly assigned copending U.S. application Ser. No. 07/389,429.

BRIEF DESCRIPTION OF THE DRAWING

The above objects, features and advantages of my invention will become more readily apparent from the following description, reference being made to the accompanying drawing in which.

SPECIFIC DESCRIPTION

Figure 1:
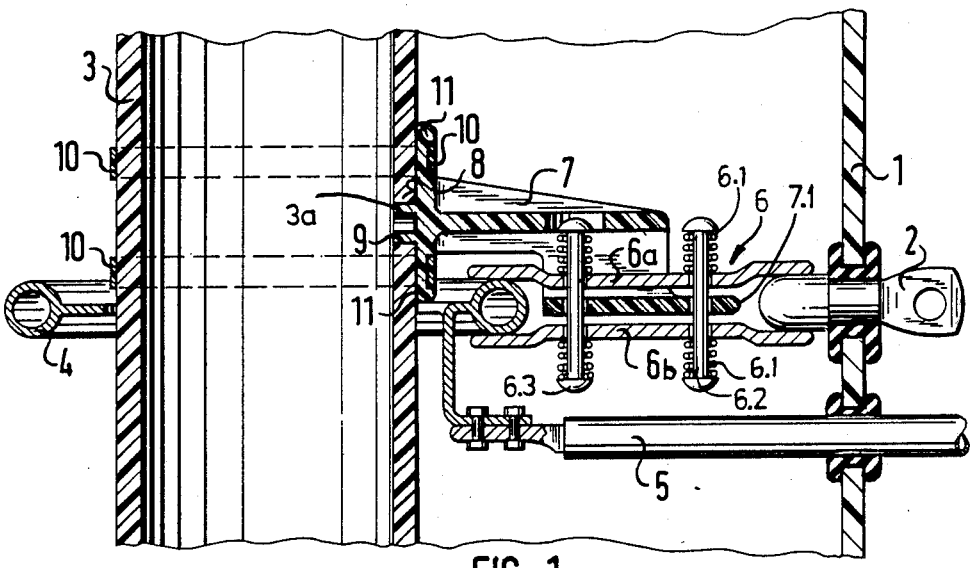
FIG. 1 is a fragmentary axial section through a portion of a step selector, according to the invention, showing only one of the support arms, its contact bridge and one fixed contact, it being understood that a plurality of such contact arms can be spaced along the shaft and three such contact arms can be spaced around the shaft and in the same plane utilizing the principles of the invention.

As will be apparent from the drawing, the step selector comprises an electrically insulating cylinder 1 which is the supporting member of the step selector and can have the tubular switching shaft 3 journaled thereon by the journaling system shown in the copending U.S. application Ser. No. 07/389,422.

The cylinder 1 serves as a support for the fixed step contacts 2 which can lie in different planes perpendicular to the axis of the shaft 3 and of the cylinder 1 which is coaxial with the shaft 3.

The shaft 3 can be driven in a stepwise manner about the axis to select the transformer steps.

For each contact plane, a contact ring 4 is provided and can surround the switching shaft 3 without engagement therewith, i.e. with all-around clearance. The ring 4 is fixed on the wall of the cylinder 1 by a connecting conductor 5, e.g. a bus bar.

A contact bridge can continuously slide on the contact ring 4 at its inner end and serves to electrically connect this contact ring with a fixed step contact 2. To this end, the members **6*a* and 6*b* of the bridge 6 can be pressed toward one another and against the ring 4 and the contact 2 by springs 6.1 surrounding pins 6.2 and braced against the heads 6.3 thereof and against the plates 6*a* and 6*b***.

The contact bridge 6 is held on the switching shaft 3 by a support arm 7 which is composed entirely of electrically insulating material and has a portion 7.1 reaching between the plates **6*a* and 6*b* and traversed by the pins 6.1. The support arm 7 is formed unitarily with the flange 8 having an arc-segmental cross section conforming to the tubular configuration of the switching shaft 3** and resting against the outer surface thereof over an arc of the latter which approximates 120°.

From the inner face of the flange 8, a projection 9 extends radially inwardly through an opening **3*a* in the wall of the shaft 3**.

In addition, the support arm 7 is held on the shaft by a pair of electrically insulating bands or straps 10 of synthetic resin impregnating self-hardening plastic material which impregnates a fibrous reinforcing strip. The best results have been achieved with glass fiber woven or nonwoven bands impregnated with epoxy resin.

Figure 2:
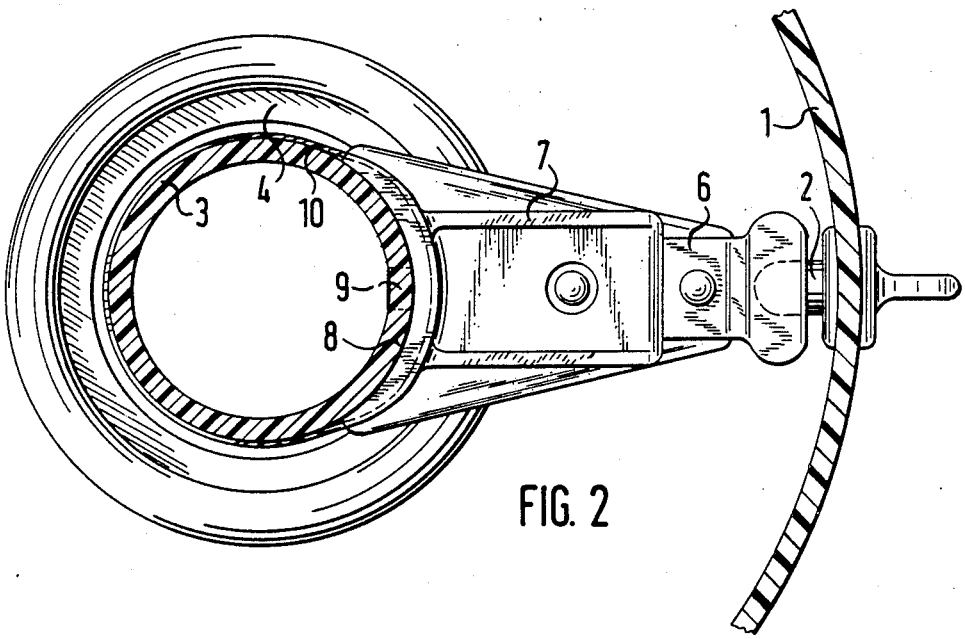
FIG. 2 is a transverse section taken through the region shown in FIG. 1, depicting the support arm from above.

As is shown clearly in FIGS. 1 and 2, the insulating bands are wound in at least one turn around the flange and the shaft 3 above and below the arm 7.

A single band can be used with light weight arms, the two bands being preferred for larger and heavier constructions of the step selector.

I claim:

1. A cylindrical step selector for a stepped transformer, comprising:

a cylinder having an electrically insulating wall;

a fixed contact for switching a transformer step mounted in said wall in a plane perpendicular to an axis of the cylindrical wall;

a generally cylindrical rotatable switching shaft of electrically insulating material disposed along said axis inwardly of said cylinder wall;

an electrically conductive contact ring lying generally in said plane and surrounding said shaft without rotatable entrainment by said shaft;

a bridge support affixed to said shaft, said support being formed with:

a generally radial arm;

a flange at one end of said arm shaped to conform to said shaft and fitting around said shaft over substantially 120° thereof, a projection formed on said flange and engaged in a recess formed in said shaft, and at least one self-hardening insulating band of a resin impregnated material wrapped around said shaft and said flange and securing said bridge support to said shaft;

an electrically conductive contact bridge carried by the other end of said arm and slidably engaging said contact ring and engageable with said fixed contact; and means forming an electrical connection with said contact ring.

2. The step selector defined in claim 1 wherein said shaft is tubular.

3. The step selector defined in claim 2 wherein said contact bridge comprises a pair of contact members straddling a portion of said arm and extending radially in opposite directions beyond said portion of said arm into slidable engagement with said contact ring and said fixed contact.

4. The step selector defined in claim 3, further comprising means for resiliently pressing said pair of contact members toward one another.

5. The step selector defined in claim 4 wherein said means for resiliently pressing said pair of contact members toward one another includes pins projecting through said portion of said arm and said pair of contact members and springs braced against heads of said pins and said pair of contact members and surrounding said pins.

6. The step selector defined in claim 5 wherein two of said self-hardening insulating bands of said resin impregnated material are provided on opposite axial sides of said arm.

7. The step selector defined in claim 6 wherein said contact ring surrounds said shaft with all-around clearance and is supported within said cylindrical wall bgy said means forming said electrical connection with said contact ring.

* * * * *